US009651257B2

(12) United States Patent
Taimura

(10) Patent No.: US 9,651,257 B2
(45) Date of Patent: May 16, 2017

(54) HEATER AND GLOW PLUG EQUIPPED WITH SAME

(71) Applicant: KYOCERA Corporation, Kyoto-shi, Kyoto (JP)

(72) Inventor: Kotaro Taimura, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 23 days.

(21) Appl. No.: 14/434,011

(22) PCT Filed: Oct. 29, 2013

(86) PCT No.: PCT/JP2013/079312
§ 371 (c)(1),
(2) Date: Apr. 7, 2015

(87) PCT Pub. No.: WO2014/069480
PCT Pub. Date: May 8, 2014

(65) Prior Publication Data

US 2015/0241060 A1 Aug. 27, 2015

(30) Foreign Application Priority Data

Oct. 29, 2012 (JP) ..... 2012-238086

(51) Int. Cl.
*H05B 1/02* (2006.01)
*F23Q 7/00* (2006.01)
*H05B 3/48* (2006.01)

(52) U.S. Cl.
CPC ..... *F23Q 7/001* (2013.01); *H05B 3/48* (2013.01); *H05B 2203/027* (2013.01)

(58) Field of Classification Search
CPC ..... F24Q 7/001; H05B 1/0236; H05B 3/48; H05B 3/0042
(Continued)

(56) References Cited

U.S. PATENT DOCUMENTS 5,362,944 A 11/1994 Hatanaka et al.
2002/0162834 A1* 11/2002 Asano ..... F23Q 7/001 219/541
(Continued)

FOREIGN PATENT DOCUMENTS

JP 7-217886 A 8/1995
JP 2001-241660 A 9/2001
(Continued)

OTHER PUBLICATIONS

Japanese Information Offer Form with English concise explanation, Japanese Patent Application No. 2014-544532, Sep. 18, 2015, 6 pgs.
(Continued)

*Primary Examiner* — Mark Paschall
(74) *Attorney, Agent, or Firm* — Volpe and Koenig, P.C.

(57) ABSTRACT

Disclosed is a heater including: an insulating base; a heating element buried in the insulating base and formed of a first linear section, a second linear section provided in parallel with the first linear section, and a folded section configured to connect the first linear section and the second linear section; a first lead buried in the insulating base and connected to the first linear section; and a second lead buried in the insulating base and connected to the second linear section. The first linear section is inclined relative to the first lead.

5 Claims, 4 Drawing Sheets

(58) Field of Classification Search
USPC ..... 219/494, 202, 205, 206, 497, 499, 505; 123/145 A
See application file for complete search history.

(56) References Cited

U.S. PATENT DOCUMENTS

| | | | | |
|---|---|---|---|---|
| 2006/0011602 | A1* | 1/2006 | Konishi | F23Q 7/00 219/270 |
| 2008/0302776 | A1 | 12/2008 | Arima et al. | |
| 2010/0213188 | A1* | 8/2010 | Nishihara | F23Q 7/001 219/544 |
| 2011/0114622 | A1* | 5/2011 | Sekiguchi | F23Q 7/001 219/270 |
| 2011/0253704 | A1* | 10/2011 | Yamamoto | F23Q 7/001 219/544 |

FOREIGN PATENT DOCUMENTS

| | | | | |
|---|---|---|---|---|
| JP | 2009-224317 | A | | 10/2009 |
| JP | 2009224317 | A | † | 10/2009 |
| WO | 2005/117492 | A1 | | 12/2005 |
| WO | 2011/065366 | A1 | | 6/2011 |
| WO | 2012/118100 | A1 | | 9/2012 |
| WO | 2012118100 | A1 | † | 9/2012 |

OTHER PUBLICATIONS

International Search Report, PCT/JP2013/079312, Dec. 3, 2013, 2 pgs.
Extended European Search Report, European Patent Application No. 13850308.1, Apr. 22, 2016, 6 pgs.
Chinese Office Action with English concise explanation, Chinese Patent Application No. 201380050457.7, Oct. 10, 2015, 7 pgs.

* cited by examiner
† cited by third party (a)

(b)

HEATER AND GLOW PLUG EQUIPPED WITH SAME

TECHNICAL FIELD

The present invention relates to a heater, for example, an ignition heater or a flame detection heater for a vehicle-mounted combustion heating apparatus, an ignition heater for various combustion equipment such as a kerosene fan heater, a heater for a glow plug for an automotive engine, a heater for various sensors such as an oxygen sensor, or a heater for heating measurement equipment, and to a glow plug equipped with the heater.

BACKGROUND ART

A ceramic heater for a glow plug is made of a conductive ceramic material of a conductor and an insulating ceramic material of a ceramic base. The conductor is formed of a heating element and a lead, and the materials of the heating element and the lead are selected and the shapes thereof are designed in such a manner that a resistance value of the lead is less than that of the heating element.

In recent years, there has been a demand for a heater, the temperature of which can be increased very quickly. For this reason, it is necessary to apply a voltage to the heating element higher than an applied voltage in the related art, and to allow high current to flow through the heating element. However, when high current flows through the heating element, parts of the heater may generate a locally large amount of heat, and thereby high thermal expansion may occur locally. As a result, there is a problem in that high thermal stress may occur locally, and the durability of the heater may decrease.

SUMMARY OF INVENTION

According to an aspect of the present invention, there is provided a heater including: an insulating base; a heating element buried in the insulating base and formed of a first linear section, a second linear section provided in parallel with the first linear section, and a folded section configured to connect the first linear section and the second linear section; a first lead buried in the insulating base and connected to the first linear section; and a second lead buried in the insulating base and connected to the second linear section. The first linear section is inclined relative to the first lead.

DESCRIPTION OF EMBODIMENTS

Examples of a heater according to an embodiment of the present invention will be described in detail with reference to the accompanying drawings.

Figure 1:
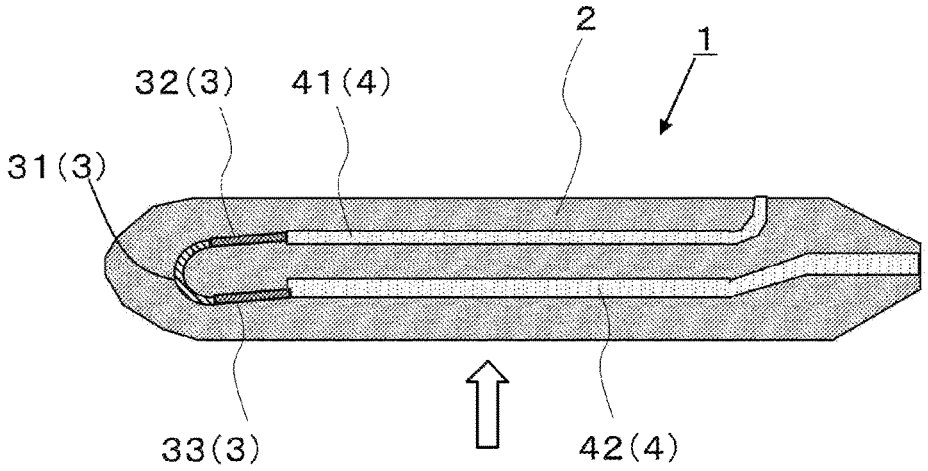
FIG. 1(*a*) is a schematic longitudinal cross-sectional view illustrating an example of a heater according to an embodiment of the present invention, and FIG. 1(*b*) is a schematic perspective view of the heater illustrated in FIG. 1(*a*) when seen upward from the bottom.
Figure 1:
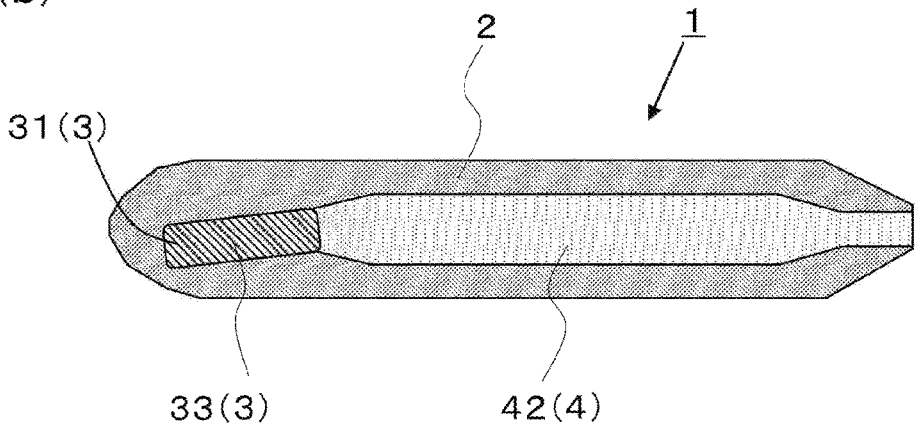

A heater 1 illustrated in FIG. 1 includes an insulating base 2; a heating element 3 buried in the insulating base 2; and a lead 4 buried in the insulating base 2 and connected to the heating element 3. The heating element 3 is inclined relative to the lead 4.

The heating element 3 is formed of a first linear section 32; a second linear section 33 provided in parallel with the first linear section 32; and a folded section 31 configured to connect the first linear section 32 and the second linear section 33. The lead 4 is formed of a first lead 41 connected to the first linear section 32, and a second lead 42 connected to the second linear section 33. The first linear section 32 is inclined relative to the first lead 41. The second linear section 33 is inclined relative to the second lead 42.

In the embodiment, for example, the insulating base 2 of the heater 1 is formed in a bar shape. The heating element 3 and the lead 4 are buried in the insulating base 2. Here, the insulating base 2 of the example is made of a ceramic material. Accordingly, it is possible to provide the heater 1 that is highly reliable when the temperature of the heater 1 is quickly increased. Specifically, the insulating base 2 of the example is made of a ceramic material having electrical insulating properties, for example, oxide ceramics, nitride ceramics, or carbide ceramics. In particular, the insulating base 2 is preferably made of silicon nitride ceramics. Silicon nitride, a main constituent of silicon nitride ceramics, has high strength, high toughness, high insulating properties, and good heat resistance. For example, it is possible to obtain the insulating base 2 made of silicon nitride ceramics by adding 3% by mass to 12% by mass of rare earth element oxide (for example, $Y_2O_3$, $Yb_2O_3$, or $Er_2O_3$) as a sintering aid, and 0.5% by mass to 3% by mass of $Al_2O_3$ to silicon nitride (main constituent), mixing the resultant compound with $SiO_2$ in such a manner that a sintered compact contains 1.5% by mass to 5% by mass of $SiO_2$, forming the sintered compact in a predetermined shape, and then firing the sintered compact in hot pressing conditions at 1650° C. to 1780° C. For example, the insulating base 2 is formed to have a length of 20 mm to 50 mm and a diameter of 3 mm to 5 mm.

The heating element 3 is buried on a tip side of the insulating base 2. For example, the distance between a tip (the vicinity of a middle point of the folded section 31) of the heating element 3 and a rear end (a connection portion connected to the lead 4) of the heating element 3 is 2 mm to 10 mm. The heating element 3 can have a circular, elliptical, or rectangular horizontal cross-sectional shape. The heating element 3 is formed to have a cross-sectional area smaller than that of the lead 4 that will be described later.

It is possible to use a carbide, a nitride, or a silicide of W, Mo, Ti, or the like as a main constituent of the material of the heating element 3. When the insulating base 2 is made of silicon nitride ceramics, tungsten carbide (WC) among the above-mentioned materials is good as the material of the heating element 3 in that tungsten carbide results in a small difference in thermal expansion coefficient between the heating element 3 and the insulating base 2, and has high heat resistance and low specific resistance. When the insulating base 2 is made of silicon nitride ceramics, preferably, the heating element 3 has WC as a main constituent, which is an inorganic conductor, and the content of silicon nitride to be added to the heating element 3 is 20% by mass or greater. For example, since the conductor constituent of the heating element 3 has a high thermal expansion coefficient compared to that of silicon nitride, typically, tensile stress is applied to the heating element 3 from the insulating base 2 inside the insulating base 2 made of silicon nitride ceramics. Meanwhile, it is possible to bring the thermal expansion coefficient of the heating element 3 close to that of the insulating base 2 by adding silicon nitride to the heating element 3. Accordingly, it is possible to reduce thermal stress that occurs between the heating element 3 and the insulating base 2 when the temperature of the heater 1 is increased and decreased.

One end of the first lead 41 of the lead 4 is connected to the first linear section 32, and the other end of the first lead 41 comes from a side surface close to a rear end of the insulating base 2. One end of the second lead 42 is connected to the second linear section 33, and the other end of the second lead 42 comes from a rear end portion of the insulating base 2.

The lead 4 is made of the same material as that of the heating element 3. For example, it is possible to decrease a resistance value of the lead 4 per unit length by increasing a cross-sectional area of the lead 4 to greater than that of the heating element 3, or decreasing the content of the material of the insulating base 2 to less than that of the heating element 3. In particular, WC is preferably used as the material of the lead 4 in that WC results in a small difference in thermal expansion coefficient between the lead 4 and the insulating base 2, and has high heat resistance and low specific resistance. Preferably, the lead 4 has WC as a main constituent, which is an inorganic conductor, and the content of silicon nitride to be added to the lead 4 is 15% or greater.

In the heater 1 of the example, the first linear section 32 is inclined relative to the first lead 41. When the first linear section 32 is not inclined relative to the first lead 41, heat is generated from the folded section 31 more than from the first linear section 32, thereby causing a deviation in the amount of heat generated from the heating element 3. Inferentially, the reason for this is that the folded section 31 inclined relative to a flow direction of electricity has high inrush current even though the resistance value of the folded section 31 per unit length is the same as that of the first linear section 32. In the heater 1 of the example, since the first linear section 32 is inclined relative to the first lead 41, the first linear section 32 also has high inrush current. Accordingly, it is possible to increase the amount of heat generated from the first linear section 32, and thereby it is possible to reduce a deviation in the amount of heat generated from the heating element 3. Accordingly, since parts of the heating element 3 generate a locally large amount of heat when high current flows through the heater 1, it is possible to reduce the probability that high thermal expansion occurs locally. As a result, it is possible to reduce an occurrence of high local thermal stress, and thereby it is possible to improve the durability of the heater 1.

Since the first linear section 32 is inclined relative to the first lead 41 by 5 degrees to 20 degrees, it is possible to obtain the above-mentioned effects. In particular, it is possible to further reduce a temperature difference in the heating element 3 by inclining the first linear section 32 by 11 degrees to 16 degrees.

As illustrated in FIG. 1, the heating element 3 includes the first linear section 32; the second linear section 33; and the folded section 31. The first linear section 32 and the second linear section 33 are respectively connected to the first lead 41 and the second lead 42. The first lead 41 and the second lead 42 are provided in parallel with each other except for the respective portions thereof being drawn to the outside from the insulating base 2. The first linear section 32 is connected to the first lead 41 while being inclined with respect thereto. The second linear section 33 is connected to the second lead 42 while being inclined with respect thereto. Since the second linear section 33 is also inclined relative to the second lead 42, it is possible to reduce a temperature difference in the heating element 3.

In addition, in the heater 1 of the example, the first linear section 32 and the second linear section 33 are inclined relative to a plane configured to include both of axes of the first lead 41 and the second lead 42. Accordingly, it is possible to incline the first linear section 32 relative to the first lead 41 while a gap between the first linear section 32 and the second linear section 33 is maintained. As a result, it is possible to reduce the possibility of the first linear section 32 and the second linear section 33 to short-circuit each other.

Figure 2:
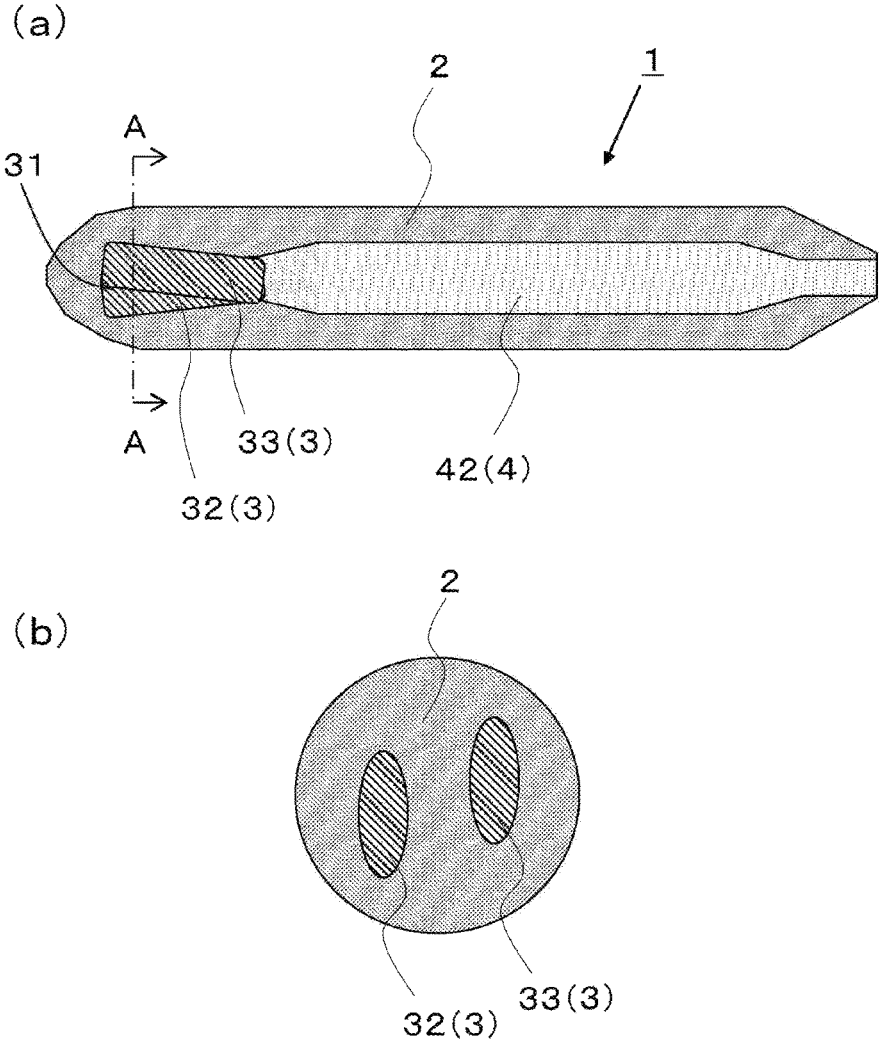
FIG. 2(*a*) is a schematic perspective view illustrating another example of the heater, and FIG. 2(*b*) is a schematic cross-sectional view taken along line A-A illustrated in FIG. 2(*a*).

Subsequently, another example of the heater 1 will be described. In the other example of the heater 1 illustrated in FIG. 2, the first linear section 32 is inclined downward relative to the first lead 41 as illustrated in FIG. 2(*a*), and the second linear section 33 is inclined upward relative to the second lead 42 as illustrated in FIG. 2(*a*). As such, since the first linear section 32 and the second linear section 33 are inclined in different directions, it is possible to reduce a deviation in the heat circumferential distribution of the insulating base 2 in the heater 1 compared to when the first linear section 32 and the second linear section 33 are inclined in the same direction.

Figure 3:
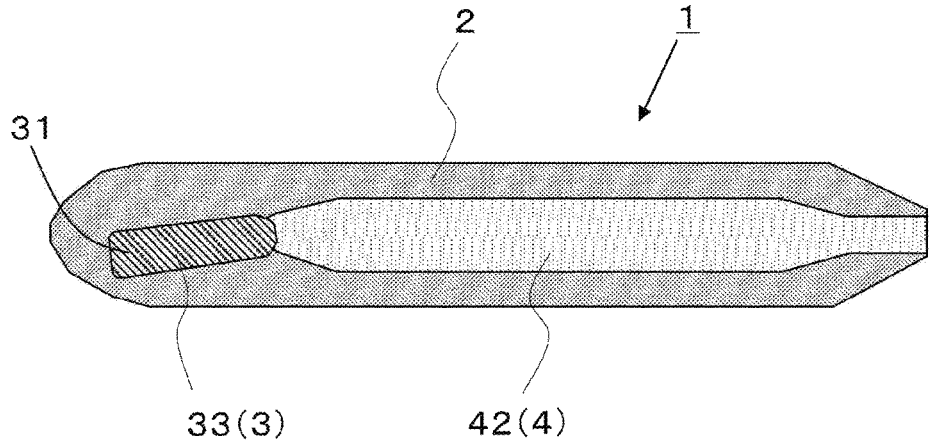
FIG. 3 is a schematic perspective view illustrating another example of the heater.

Subsequently, still another example of the heater 1 will be described. In the other example of the heater 1 illustrated in FIG. 3, the second linear section 33 is inclined relative to the second lead 42, and a connection portion of the second linear section 33 to the second lead 42 is thinner than other portions of the second linear section 33. Accordingly, the connection portion of the second linear section 33 to the second lead 42 has a cross-sectional area smaller than that of the other portions of the second linear section 33. A connection portion of the first linear section 32 to the first lead 41 is thinner than other portions of the first linear section 32, which is not illustrated in FIG. 3. Accordingly, the connection portion of the first linear section 32 to the first lead 41 has a cross-sectional area smaller than that of the other portions of the first linear section 32. With this configuration, the connection portions between the heating element 3 and the lead 4 can easily generate heat locally. It is possible to further reduce the above-mentioned deviation in the amount of heat generated from the heating element 3.

Figure 4:
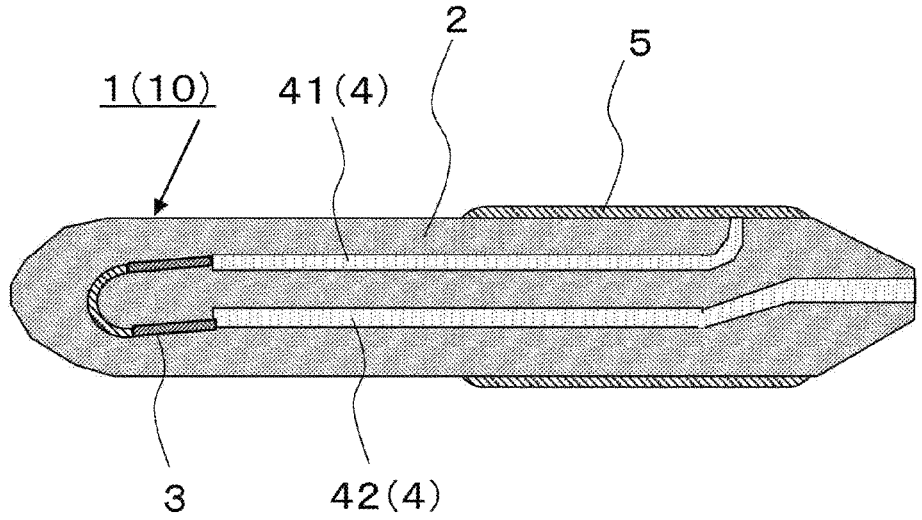
FIG. 4 is a schematic longitudinal cross-sectional view illustrating an example of a glow plug according the embodiment of the present invention.

As illustrated in FIG. 4, the heater 1 can be used in a glow plug 10 equipped with a metallic holding member 5 configured to hold the heater 1. The metallic holding member 5 is a cylindrical metal body configured to hold the heater 1. The metallic holding member 5 is joined to the first lead 41 using a brazing material, the first lead 41 being drawn out from the side surface of the insulating base 2, and is electrically connected to the first lead 41. When external electrodes are respectively connected to the metallic holding member 5 and the second lead 42, the glow plug 10 can be used.

Subsequently, an example of a method of manufacturing the heater 1 of the embodiment will be described.

For example, it is possible to form the heater 1 of the embodiment by an injection molding method or the like using molds shaped to the contours of the heating element 3, the lead 4, and the insulating base 2. First, a conductive paste containing conductive ceramic powder, a resin binder, and the like, which is the material of the heating element 3 and the lead 4, is manufactured, and a ceramic paste containing insulating ceramic powder, a resin binder, and the like, which is the material of the insulating base 2, is manufactured.

Subsequently, a predetermined pattern of a compact (an article becoming the heating element 3) made of the conductive paste is made of the conductive paste by the injection molding method or the like. The mold is filled with the conductive paste in a state where the heating element 3 is held in the mold, and a predetermined pattern of a compact (an article becoming the lead 4) made of the conductive paste is formed. Accordingly, the heating element 3 and the lead 4 connected to the heating element 3 are held in the mold. At this time, the heating element 3 is set to be inclined relative to the lead 4, and thereby the heating element 3 can be inclined relative to the lead 4 in the heater 1 after a final compact is fired.

Subsequently, in a state where parts of the heating element 3 and the lead 4 are held in the mold, a part of the mold is replaced with the mold for the molding of the insulating base 2, and then the mold is filled with the ceramic paste that is the material of the insulating base 2. Accordingly, it is possible to obtain a compact for the heater 1, in which the heating element 3 and the lead 4 are covered with the compact made of the ceramic paste.

Subsequently, for example, it is possible to manufacture the heater 1 by firing the obtained compact at a temperature of 1650° C. to 1780° C. and a pressure of 30 MPa to 50 MPa. The firing is performed under a non-oxidizing gas atmosphere consisting of hydrogen gas.

EXAMPLE

The heater according to Example of the present invention was manufactured in the following manner.

First, the heating element having a shape illustrated in FIG. 1 was manufactured by injection molding a conductive paste in the mold, the conductive paste containing 50% by mass of tungsten carbide (WC) powder, 35% by mass of silicon nitride ($Si_3N_4$) powder, and 15% by mass of a resin binder.

Subsequently, in a state where the heating element 3 was held in the mold, the mold was filled with the conductive paste that is the material of the lead 4, and thereby the conductive paste was connected to the heating element 3, and the lead 4 was formed. At this time, the heating element 3 was set to be inclined relative to the lead 4 in Samples 1 to 6 that were the heaters according to Example of the present invention. Specifically, in Samples 1 to 6, the first linear section 32 and the second linear section 33 were set to be inclined relative to a plane configured to include both of the axes of the first lead 41 and the second lead 42. In addition, a heater in which the heating element 3 was not inclined relative to the lead 4 was also manufactured as Comparative Example.

Subsequently, in a state where the heating element 3 and the lead 4 were held in the mold, a ceramic paste was injection molded in the mold, the ceramic paste containing 85% by mass of silicon nitride ($Si_3N_4$) powder, 10% by mass of ytterbium oxide ($Yb_2O_3$) of ytterbium (Yb) as a sintering aid, and 5% by mass of tungsten carbide (WC). As a result, the heater 1 configured such that the heating element and the lead 4 were buried in the columnar insulating base 2 was formed.

Subsequently, sintering was performed by putting the obtained heater 1 into a cylindrical carbon die, and then hot pressing the heater 1 at a temperature of 1700° C. and a pressure of 35 MPa under a non-oxidizing gas atmosphere consisting of nitrogen gas. In this manner, the heaters were manufactured.

The internal shapes of the heaters in Samples 1 to 6 were confirmed by X-ray, and it was confirmed that the first linear section 32 and the second linear section 33 were inclined relative to a plane configured to include both of axes of the first lead 41 and the second lead 42. Specifically, the first linear section 32 and the second linear section 33 were inclined at 5 degrees relative to the plane in Sample 1, 8 degrees in Sample 2, 11 degrees in Sample 3, 16 degrees in Sample 4, 17 degrees in Sample 5, and 20 degrees in Sample 6. In Comparative Example, the first linear section 32 and the second linear section 33 were not inclined. The width of the heating element 3 is 0.4 mm, and the thickness is 0.9 mm, and the axial length of the insulating base 2 is approximately 4.5 mm, in which the heating element 3 is provided.

After Samples 1 to 6 and Comparative Example were energized for a predetermined amount of time, the temperature of the surface of the insulating base 2 was measured. As a result, in all of Samples 1 to 6 and Comparative Example, the temperature was the highest in the vicinity of the folded section 31, and decreased toward the lead 4 therefrom. Table 1 illustrates measurement results for the temperature of the vicinity of the folded section 31 and the vicinity of the connection portion between the heating element 3 and the lead 4.

TABLE 1

| Sample Number | Incline Angle [degrees] | Temperature Difference [° C.] | Temperature of Vicinity of Folded Section [° C.] | Temperature of Vicinity of Connection Portion [° C.] |
|---|---|---|---|---|
| Comparative Example | 0 | 75 | 1203 | 1128 |
| Sample 1 | 5 | 56 | 1201 | 1145 |
| Sample 2 | 8 | 55 | 1211 | 1156 |
| Sample 3 | 11 | 39 | 1203 | 1164 |
| Sample 4 | 16 | 37 | 1212 | 1175 |
| Sample 5 | 17 | 46 | 1200 | 1154 |
| Sample 6 | 20 | 54 | 1189 | 1135 |

As illustrated in Table 1, in Comparative Example, the temperature of the vicinity of the folded section 31 is 1203° C., the temperature of the vicinity of the connection portion is 1128° C., and a temperature difference of 75° C. therebetween occurred. In contrast, in Samples 1 to 6, a temperature difference between the vicinity of the folded section 31 and the vicinity of the connection portion was reduced to 37° C. to 56° C. The main reason for this was that the temperature of the vicinity of the connection portion in Samples 1 to 6 was higher than that of the vicinity of the connection portion in Comparative Example. From the above-mentioned results, it was confirmed that it was possible to increase the amount of heat generated from the first linear section 32 and the second linear section 33 by inclining the heating element 3 relative to the lead 4, and to reduce a deviation in the amount of heat generated from the heating element 3.

Figure 5:
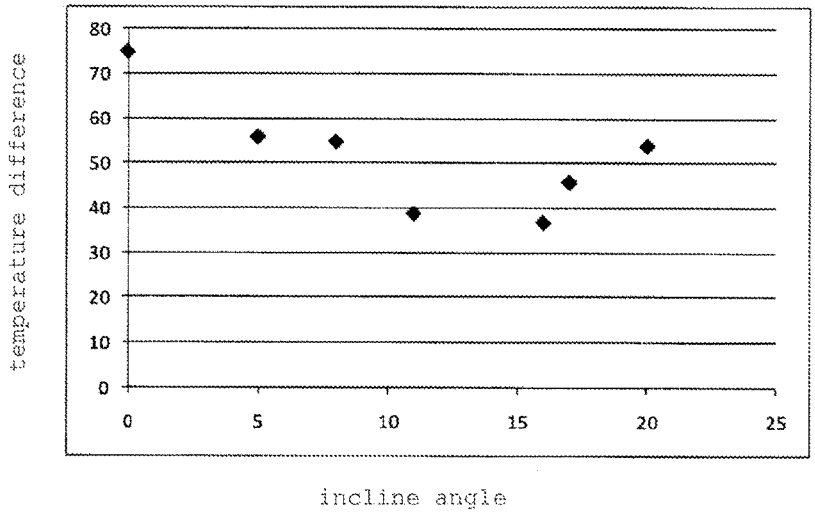
FIG. 5 illustrates a relationship between an incline angle and a temperature difference that is present between a vicinity of a folded section and a vicinity of a connection portion.

FIG. 5 illustrates a relationship between an incline angle and the temperature difference that is present between the vicinity of the folded section 31 and the vicinity of the connection portion.

As can be seen from FIG. 5, it was possible to reduce the temperature difference between the vicinity of the folded section 31 and the vicinity of the connection portion by setting the incline angle to 5 degrees to 20 degrees, compared to when the incline angle was 0 degrees. In addition, it could be seen that it was possible to reduce a deviation in the amount of heat generated from the heating element 3 particularly when the incline angle was set to 11° C. to 16° C.

REFERENCE SIGNS LIST

1: heater
10: glow plug
2: insulating base
3: heating element
31: folded section
32: first linear section
33: second linear section
4: lead
41: first lead
42: second lead

The invention claimed is:

1. A heater comprising:

an insulating base;

a heating element buried in the insulating base and formed of a first linear section, a second linear section provided in parallel with the first linear section, and a folded section configured to connect the first linear section and the second linear section;

a first lead buried in the insulating base and connected to the first linear section; and a second lead buried in the insulating base and connected to the second linear section, wherein in a plane configured to include a longitudinal axis of the first lead and a longitudinal axis of the second lead, a longitudinal axis of the first linear section is inclined relative to the longitudinal axis of the first lead, a longitudinal axis of the second linear section is inclined relative to the longitudinal axis of the second lead, and the longitudinal axis of the first linear section and the longitudinal axis of the second linear section are inclined in a same direction.

2. The heater according to claim 1, wherein the longitudinal axis of the first linear section and the longitudinal axis of the second linear section are inclined relative to the plane configured to include the longitudinal axis of the first lead and the longitudinal axis of the second lead.

3. The heater according to claim 2, wherein the longitudinal axis of the first linear section and the longitudinal axis of the second linear section are inclined at an angle of 5 degrees to 20 degrees relative to the plane configured to include the longitudinal axis of the first lead and the longitudinal axis of the second lead.

4. The heater according to claim 2, wherein the longitudinal axis of the first linear section and the longitudinal axis of the second linear section are inclined at an angle of 11 degrees to 16 degrees relative to the plane configured to include the longitudinal axis of the first lead and the longitudinal axis of the second lead.

5. A glow plug comprising:

the heater according to claim 1; and a metallic holding member configured to hold the heater.

* * * * *